US007192305B2

(12) United States Patent
Kato et al.

(10) Patent No.: US 7,192,305 B2
(45) Date of Patent: Mar. 20, 2007

(54) ELECTRONIC APPARATUS INCLUDING RESTRAINT MEMBER RECEIVING PLUG COUPLED TO CONNECTOR

(75) Inventors: Ju Kato, Kawasaki (JP); Minoru Kumagai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/893,265

(22) Filed: Jul. 19, 2004

(65) Prior Publication Data

US 2005/0142906 A1 Jun. 30, 2005

(30) Foreign Application Priority Data

Dec. 25, 2003 (JP) ..... 2003-430385

(51) Int. Cl.
*H01R 13/73* (2006.01)

(52) U.S. Cl. ..... 439/544

(58) Field of Classification Search ..... 439/571, 439/559, 581, 572, 544, 545, 638
See application file for complete search history.

(56) References Cited

U.S. PATENT DOCUMENTS 4,175,817 A * 11/1979 Tachick et al. ..... 439/185
4,676,575 A * 6/1987 Denlinger et al. ..... 439/271
5,046,952 A * 9/1991 Cohen et al. ..... 439/63
5,532,436 A * 7/1996 Moyers et al. ..... 174/151
6,113,424 A * 9/2000 Shinozaki ..... 439/559
6,773,286 B1 * 8/2004 Wu ..... 439/247
2004/0242073 A1 * 12/2004 Taguchi ..... 439/638

FOREIGN PATENT DOCUMENTS

CN 1368768 A 9/2002
JP 6-68285 9/1994
JP 2001-266993 9/2001

OTHER PUBLICATIONS

Office Action of Corresponding Chinese Application No. 200410055781.0 Issued on Sep. 1, 2006.

* cited by examiner

*Primary Examiner*—Chandrika Prasad
(74) *Attorney, Agent, or Firm*—Westerman, Hattori, Daniels & Adrian, LLP.

(57) ABSTRACT

An electronic apparatus has an enclosure body defining an opening for receiving a plug. A restraint member is disposed in the opening. The restraint member is designed to contact the plug. When the plug is inserted into the opening so as to reach the connector, the plug contacts the restraint member within the opening. Even when an impact is applied to the plug, the movement of the plug is thus restrained based on the contact between the plug and the restraint member. No impact is transmitted to the connector. The connector is thus reliably prevented from getting damaged.

21 Claims, 5 Drawing Sheets

ELECTRONIC APPARATUS INCLUDING RESTRAINT MEMBER RECEIVING PLUG COUPLED TO CONNECTOR

BACKGROUND OF THE INVENTION

1. Field of the Invention

The present invention relates to an electronic apparatus such as a notebook type personal computer. In particular, the invention relates to an electronic apparatus comprising a first connector designed to receive a second connector.

2. Description of the Prior Art

A notebook type personal computer is well known. A motherboard is contained within the enclosure of the notebook type personal computer. A connector for power supply is mounted on the motherboard so as to receive electric power for the central processing unit (CPU), for example. On the other hand, an opening is defined in the enclosure for receiving a plug of a power supply unit. The plug is inserted into the opening of the enclosure so as to reach the connector. The opening of the enclosure has the inner diameter larger than the outer diameter of the plug. When the plug is held in the connector, the plug is prevented from contacting the enclosure.

The plug sometimes suffers from a large impact when the notebook type personal computer is dropped on the ground, or a cable connected to the plug is strongly pulled. The connector on the motherboard should receive the impact. The connector may get damaged. The connector may often be stripped off from the motherboard. In this case, the motherboard should be replaced with new one. The user of the notebook type personal computer should be charged with the expensive cost of the replacement.

SUMMARY OF THE INVENTION

It is accordingly an object of the present invention to provide an electronic apparatus as well as an enclosure therefor capable of reliably preventing damages to a connector.

According to a first aspect of the present invention, there is provided an enclosure for an electronic apparatus, comprising: an enclosure body defining an opening for receiving a plug; and a restraint member disposed in the opening and designed to contact the plug.

When the plug is to be coupled to the connector in the enclosure, the plug is inserted into the opening so as to reach the connector. Since the restraint member is located within the opening, the plug contacts the restraint member when an impact is applied to the plug. The movement of the plug is thus restrained based on the contact between the plug and the restraint member. No impact is transmitted to the connector. The connector is thus reliably prevented from getting damaged. The restraint member may be integral to the enclosure body.

A contact surface may be defined in the restraint member so as to contact the peripheral or cylindrical surface of the plug. The restraint member may comprise an annular member defining the contact surface at the inner peripheral surface thereof. The cylindrical surface of the plug is reliably received at the inner surface of the annular member. The connector is thus reliably prevented from getting damaged.

The restraint member may have a first contact surface designed to contact a small cylindrical surface of the plug and a second contact surface designed to contact a large cylindrical surface having a diameter larger than that of the small cylindrical surface. In this case, the restraint member may comprise an annular member defining the first and second contact surfaces at the inner surface. The small and large cylindrical surfaces of the plug are reliably received on the inner surface, namely the first and second contact surfaces, respectively, of the annular member. The connector is thus reliably prevented from getting damaged.

The restraint member may have a contact surface designed to contact a step defined between a small cylindrical surface and a large cylindrical surface having a diameter larger than that of the small cylindrical surface. The step of the plug can be received on the contact surface of the restraint member when an impact is applied to the restraint member in the direction perpendicular to the step. The connector is thus reliably prevented from getting damaged. In this case, the restraint member may comprise an annular member having the inner surface designed to contact the small cylindrical surface.

According to a second aspect of the present invention, there is provided an electronic apparatus comprising: a connector receiving a plug; and a restraint member spaced from the connector and designed to contact the plug.

When the plug is to be coupled to the connector in the electronic apparatus, the plug is received in the connector. The restraint member is designed to receive the contact of the plug when an impact is applied to the plug. The movement of the plug is thus restrained based on the contact between the plug and the restraint member. No impact is transmitted to the connector. The connector is thus reliably prevented from getting damaged.

A contact surface may be defined in the restraint member so as to contact the peripheral or cylindrical surface of the plug. The restraint member may comprise an annular member defining the contact surface at the inner peripheral surface thereof. The cylindrical surface of the plug is reliably received at the inner surface of the annular member. The connector is thus reliably prevented from getting damaged.

The restraint member may have a first contact surface designed to contact a small cylindrical surface of the plug and a second contact surface designed to contact a large cylindrical surface having a diameter larger than that of the small cylindrical surface. In this case, the restraint member may comprise an annular member defining the first and second contact surfaces at the inner surface. The small and large cylindrical surfaces of the plug are reliably received on the inner surface, namely the first and second contact surfaces, respectively, of the annular member. The connector is thus reliably prevented from getting damaged.

The restraint member may have a contact surface designed to contact a step defined between a small cylindrical surface and a large cylindrical surface having a diameter larger than that of the small cylindrical surface. The step of the plug can be received on the contact surface of the restraint member when an impact is applied to the restraint member in the direction perpendicular to the step. The connector is thus reliably prevented from getting damaged. In this case, the restraint member may comprise an annular member having the inner surface designed to contact the small cylindrical surface.

The connector may be mounted on a printed circuit board in the aforementioned electronic apparatus. Major circuit components for the electronic apparatus are in general mounted on the printed circuit board. An impact is directly transmitted to the connector from the plug in a conventional electronic apparatus. The connector on the printed circuit board in this case tends to suffer from damages. On the other hand, the plug contacts the restraint member in the electronic apparatus according to the present invention. The connector is reliably prevented from receiving an impact from the plug. The connector is thus protected from the impact, so that the connector is allowed to avoid damages. In this case, the restraint member may be stationarily fixed to an enclosure designed to contain at least the printed circuit board. The restraint member may be integral to the enclosure, for example. Molding process may be employed to realize the restraint member integral to the enclosure, for example, so that the restraint member integral to the enclosure can be obtained in a facilitated manner.

An electronic apparatus may utilize any types of connectors in place of the aforementioned combination of a plug and a connector. The present invention may be applied to any types of connection, such as one between male and female connectors.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
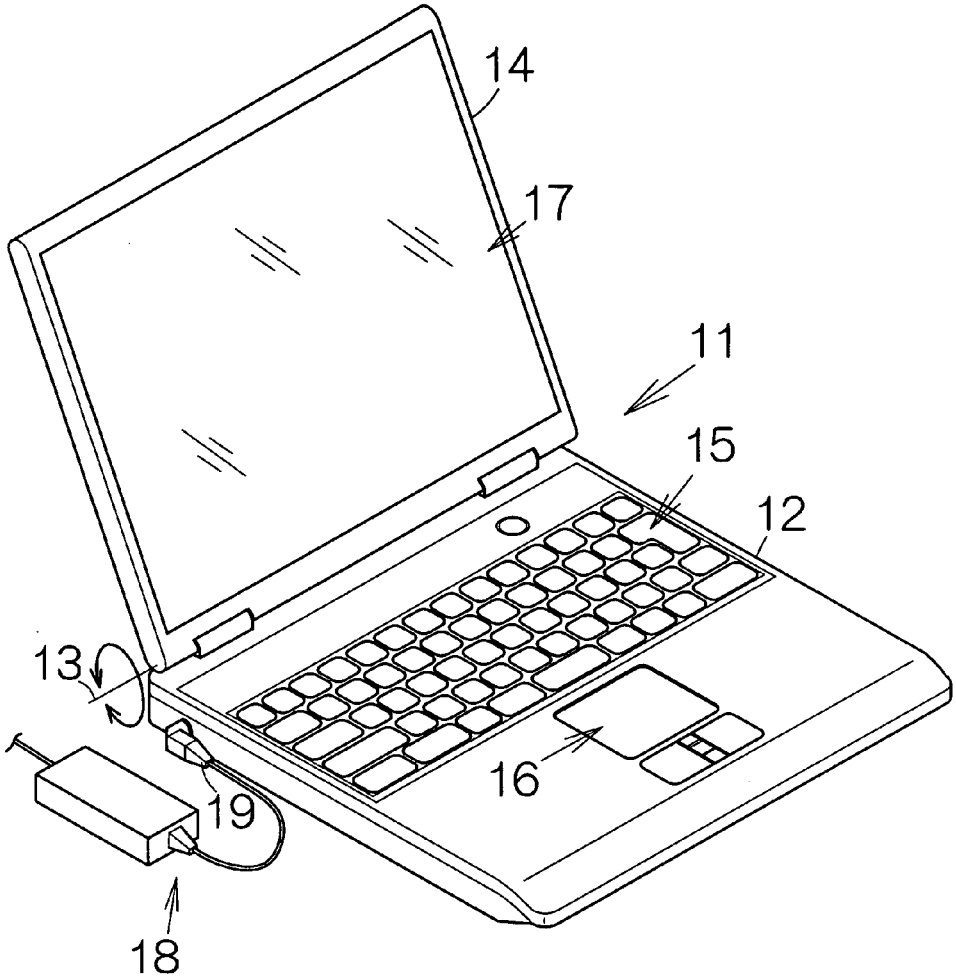
FIG. 1 is a perspective view schematically illustrating the overall structure of a notebook type personal computer as a specific example of an electronic apparatus.

FIG. 1 schematically illustrates a notebook type personal computer 11 as a specific example of an electronic apparatus. The notebook type personal computer 11 includes a thin primary enclosure 12 for main equipment. A display enclosure 14 is coupled to the primary enclosure 12 for relative swinging movement about a rotation axis 13. Input devices such as a keyboard 15 and a pointing device 16 are located on the front surface of the primary enclosure 12. A liquid crystal display (LCD) panel 17 is located within the display enclosure 14.

A plug 19 of an AC adapter 18 is inserted into the side wall of the primary enclosure 12. Alternating current is supplied to the AC adapter 18 from an outlet, not shown, for example. The AC adapter 18 serves to convert the alternating current into direct current. The direct current is supplied to the notebook type personal computer 11 through the plug 19.

Figure 2:
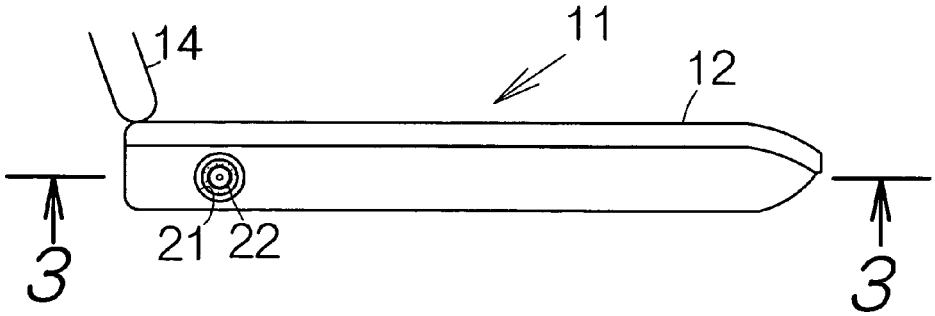
FIG. 2 is a side view of the notebook type personal computer for schematically illustrating an opening for a plug.

As shown in FIG. 2, a circular opening 21 is defined in the side wall of the primary enclosure 12. The opening 21 is designed to receive the plug 19. A connector 22 is opposed to the opening 21. The connector 22 is designed to receive the plug 19. The structure of the opening 21 and the connector 22 will be described later in detail.

Figure 3:
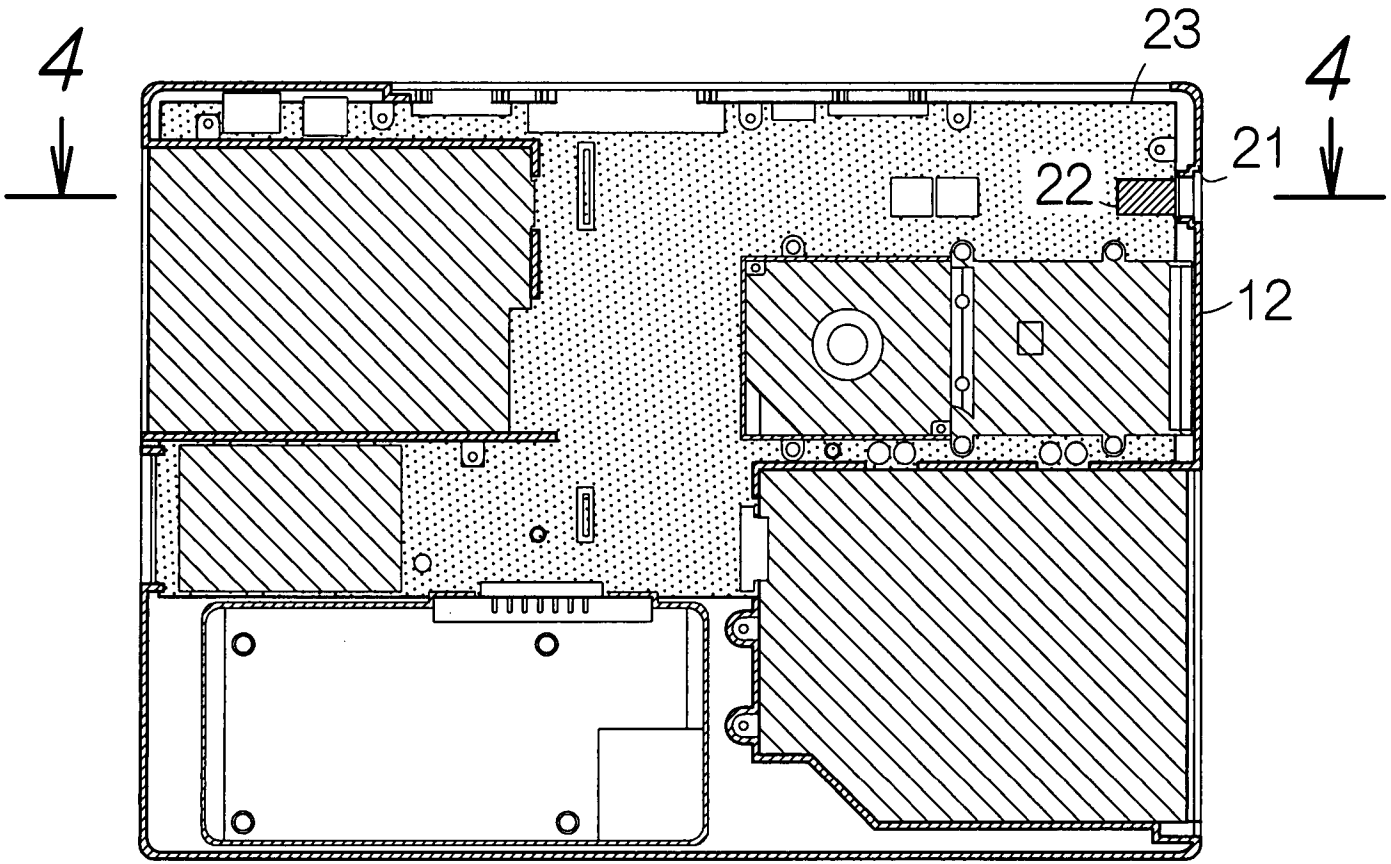
FIG. 3 is a sectional view taken along the line 3—3 in FIG. 2, for schematically illustrating the inner structure of a primary enclosure.

As shown in FIG. 3, a printed circuit board or motherboard 23 is placed within the primary enclosure 12. Major circuit components such as a CPU, a memory chip, and the like, are mounted on the motherboard 23. The CPU executes the processing based on an operating system (OS), application software programs, and the like, temporarily stored in the memory chip, for example. The user can input various data and instructions through the aforementioned keyboard 15 and the pointing device 16 for the processing of the CPU.

The connector 22 is mounted on the motherboard 23. A predetermined spacing is defined between the connector 22 and the primary enclosure 12. The plug 19 is received in the connector 22 through the opening 21. When electric connection is in this manner established between the plug 19 and the connector 22, electric power can be supplied to the CPU, the memory chip, and other electronic components on the motherboard 23 from the outlet.

Figure 4:
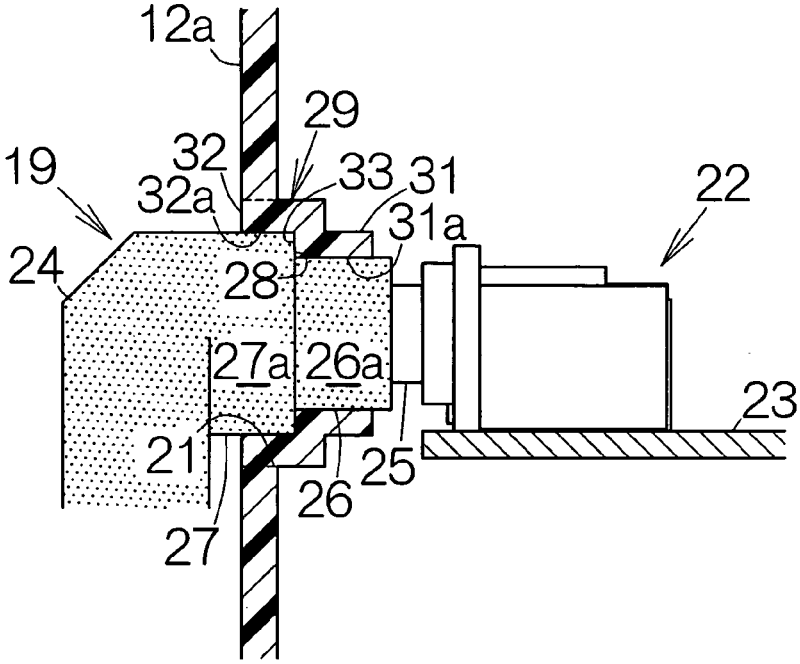
FIG. 4 is an enlarged partial sectional view taken along the line 4—4 in FIG. 3.

As shown in FIG. 4, the plug 19 includes a main body 24 made of resin and a cylindrical electrode extending forward from the main body 24. The main body 24 has a small cylindrical portion 26 and a large cylindrical portion 27. The large cylindrical portion 27 has the outer diameter larger than that of the small cylindrical portion 26. The small cylindrical portion 26 is connected to the large cylindrical portion 27 at the rear end of the small cylindrical portion 26. The central axis of the small cylindrical portion 26 is aligned with the central axis of the large cylindrical portion 27. In other words, the small and large cylindrical portions 26, 27 are coaxial to each other. A small cylindrical surface 26*a* is defined over the outer peripheral surface of the small cylindrical portion 26. A large cylindrical surface 27*a* is likewise defined over the outer peripheral surface of the large cylindrical portion 27. An annular step 28 is defined between the small and large cylindrical surfaces 26*a*, 27*a*. The step 28 extends over a plane perpendicular to the central axes of the small and large cylindrical portions 26, 27.

On the other hand, a restraint member 29 is located within the opening 21 of the primary enclosure 12. The restraint member 29 is stationarily fixed to an enclosure body 12*a* of the primary enclosure 12. Here, the restraint member 29 is integral to the enclosure body 12*a*. Molding process may be employed to realize the restraint member 29 integral to the enclosure body 12*a*. The restraint member 29 and the enclosure body 12*a* may be made of a resin material such as polycarbonate. The front end of the restraint member 29 is spaced from the connector 22.

The restraint member 29 is formed of an annular member. The shape of the restraint member 29 corresponds to the outer periphery of the main body 24 of the plug 19. In this case, the restraint member 29 includes a first annular portion 31 and a second annular portion 32. The rear end of the first annular portion 31 is connected to the second annular portion 32. The central axis of the first annular portion 31 is aligned with the central axis of the second annular portion 32. In other words, the first and second annular portions 31, 32 are coaxial to each other. In addition, the central axes of the first and second annular portions 31, 32 are aligned with the central axes of the small and large cylindrical portions 26, 27 of the plug 19. Specifically, the main body 24 of the plug 19 is set coaxial to the restraint member 29.

A first contact surface 31*a* is defined on the inner surface of the first annular portion 31. The first contact surface 31*a* is designed to contact the small cylindrical surface 26*a* of the plug 19. A second contact surface 32*a* is likewise defined on the inner surface of the second annular portion 32. The second contact surface 32*a* is designed to contact the large cylindrical surface 27*a* of the plug 19. Specifically, the inner diameter of the second annular portion 32 is set larger than the inner diameter of the first annular portion 31. A third contact surface 33 is defined between the first and second contact surfaces 31*a*, 32*a*. The third contact surface 33 is designed to contact the step 28 of the plug 19. The third contact surface 33 extends over a plane perpendicular to the central axes of the first and second contact surfaces 31*a*, 32*a*.

Figure 5:
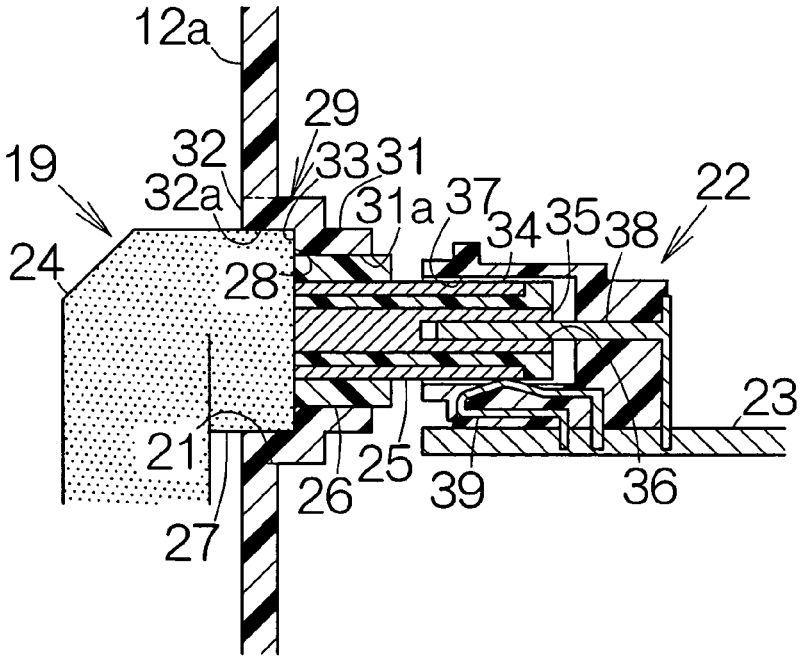
FIG. 5 is an enlarged partial sectional view of the plug and a connector.

As shown in FIG. 5, the electrode 25 of the plug 19 includes a cylindrical conductive outer sheath 34 and a central conductive column 35 located within the conductive outer sheath 34. The conductive column 35 extends along the central axis of the conductive outer sheath 34. In other words, the conductive outer sheath 34 and the conductive column 35 are coaxial to each other. Resin material is interposed between the conductive outer sheath 34 and the conductive column 35. The resin material serves to insulate the conductive outer sheath 34 from the conductive column 35. A receiving hole 36 is defined in the conductive column 35. The receiving hole 36 is designed to extend along the central axis of the conductive outer sheath 34. The conductive outer sheath 34 is exposed at the outer peripheral surface of the electrode 25.

On the other hand, a columnar hollow portion 37 is defined in the connector 22. The hollow portion 37 is designed to receive the electrode 25. A pin electrode 38 and a spring electrode 39 are disposed within the hollow portion 37. The pin electrode 38 is inserted into the receiving hole 36 of the conductive column 35 when the electrode 25 is received in the connector 22. The spring electrode 39 is designed to contact the conductive outer sheath 35 when the electrode 25 is received in the connector 22. The pin electrode 38 and the spring electrode 39 are independently connected to the motherboard 23. Soldering may be employed to establish such connections.

When the plug 19 is coupled to the connector 22, the plug 19 is inserted into the opening 21 so as to reach the connector 22. The step 28 contacts the third contact surface 33. The small cylindrical surface 26*a* likewise contacts the first contact surface 31*a*. The large cylindrical surface 27*a* contacts the second contact surface 32*a*. At the same time, the electrode 25 is inserted into the hollow portion 37 of the connector 22. The pin electrode 38 is received in the receiving hole 36 of the conductive column 35. Electric connection is thus established between the conductive column 35 and the pin electrode 38. The conductive outer sheath 34 contacts the spring electrode 39. Electric connection is thus established between the conductive outer sheath 34 and the spring electrode 39. Electric connection is in this manner established between the plug 19 and the connector 22.

Here, a predetermined spacing is defined between the front end of the main body 24 of the plug 19 and the end of the connector 22. A predetermined spacing is maintained between the front end of the electrode 25 and the bottom of the hollow portion 37. A predetermined spacing is likewise maintained between the tip end of the pin electrode 38 and the bottom of the receiving hole 36.

Figure 6:
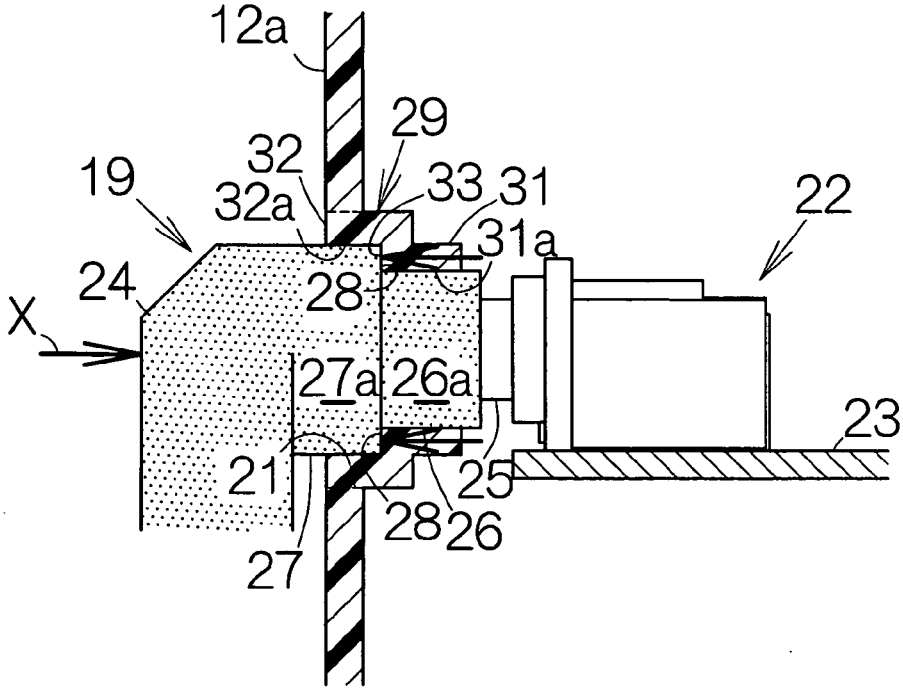
FIG. 6 is an enlarged partial sectional view corresponding to FIG. 4, schematically illustrating the plug receiving an impact.

For example, when an impact is applied to the main body 24 of the plug 19 in the direction X, as shown in FIG. 6, the impact is received on the third contact surface 33 of the restraint member 29. The main body 24 of the plug 19 is prevented from moving further in the direction X. No impact is thus transmitted to the connector 22 from the plug 19. It is possible to reliably prevent any damages to the connector 22.

Figure 7:
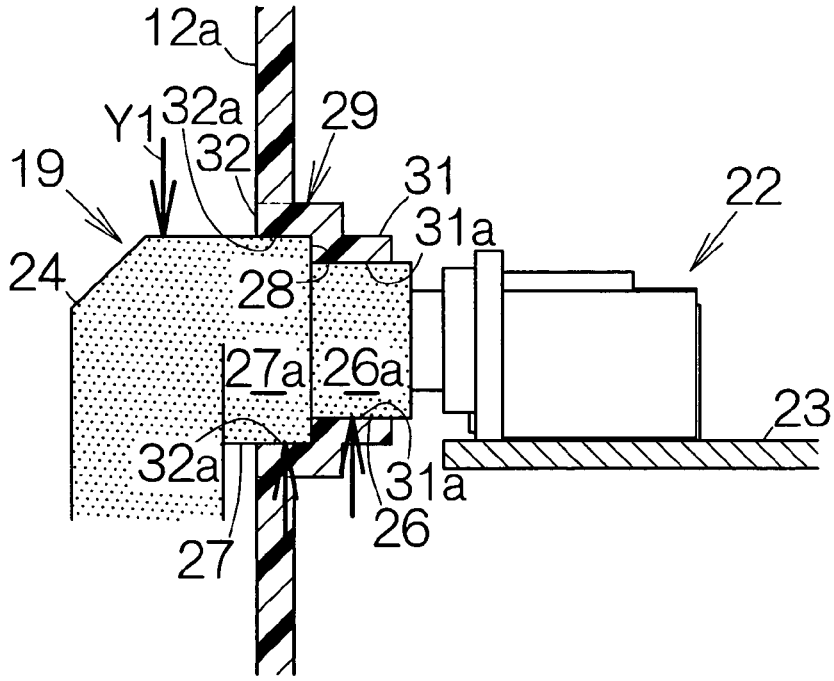
FIG. 7 is an enlarged partial sectional view corresponding to FIG. 4, schematically illustrating the plug receiving an impact.

When an impact is applied to the main body 24 of the plug 19 in the direction Y1, as shown in FIG. 7, the impact is received on the first and second contact surfaces 31*a*, 32*a* of the restraint member 29. The main body 24 of the plug 19 is thus prevented from moving further in the direction Y1. No impact is transmitted to the connector 22 from the plug 19. It is possible to reliably prevent any damages to the connector 22.

Figure 8:
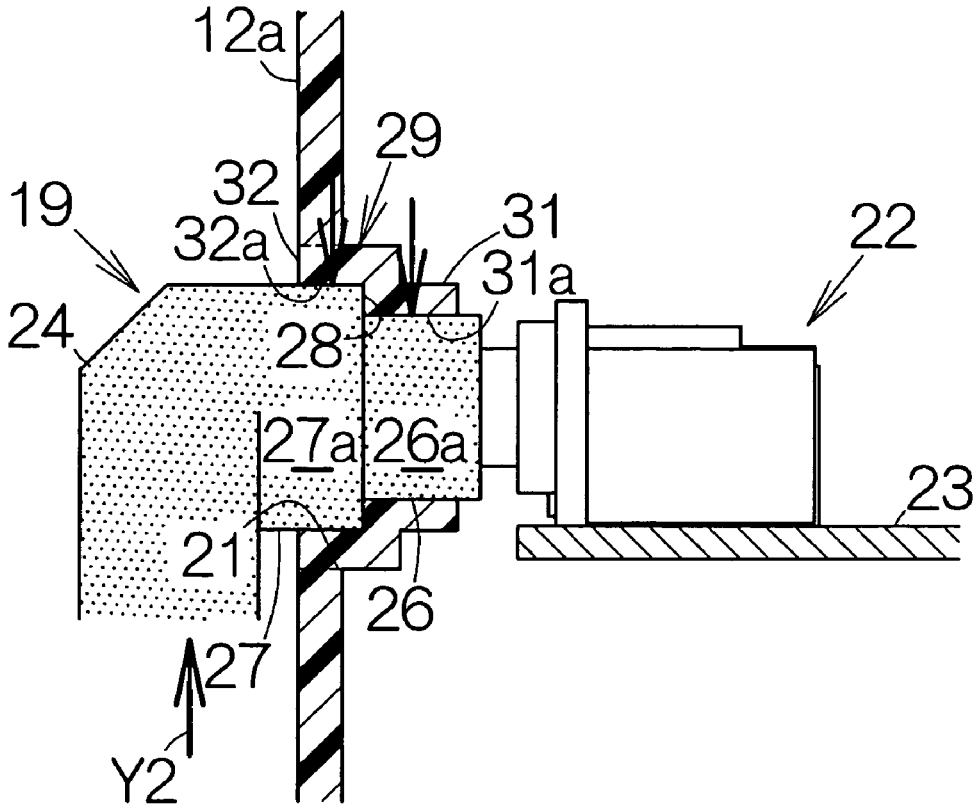
FIG. 8 is an enlarged partial sectional view corresponding to FIG. 4, schematically illustrating the plug receiving an impact.

When an impact is applied to the main body 24 of the plug 19 in the direction Y2, as shown in FIG. 8, the impact is likewise received on the first and second contact surfaces 31*a*, 32*a* of the restraint member 29. The main body 24 of the plug 19 is thus prevented from moving further in the direction Y2. No impact is transmitted to the connector 22 from the plug 19. It is possible to reliably prevent any damages to the connector 22.

On the other hand, the opening of the primary enclosure is set larger than the outer periphery of the plug in a conventional notebook type personal computer. When an impact is applied to the plug, the connector receives the impact. The connector suffers from a larger impact. The pin electrode often gores the back of the connector. The pin electrode thus drops off the connector, for example. In the worse case, the connector is removed from the motherboard. Soldering material for coupling the connector to the motherboard, wiring patterns, and the like, are stripped off from the motherboard. Short is induced in the wiring patterns on the motherboard.

It should be noted that the shape of the restraint member 29 may be set depending on the shape of a plug received in the connector 22. If the main body 24 of the plug 19 has a rectangular or square cross-section, for example, the restraint member 29 may be made of a frame member having a similar rectangular or square cross-section. Even when the main body 24 of the plug 19 is formed in a rectangular parallelepiped, the restraint member 29 may be an annular member.

The aforementioned restraint member 29 may be applied to any electronic apparatus such as a desktop type personal computer, a printer, a scanner, and the like, in addition to the aforementioned note book type personal computer. The invention may be applied to, not only the plug and connector for power supply, but also a plug and a connector for keyboard, mouse, USB connection, other types of connection. The invention may be applied to, not only connection between a plug and a connector, but also connection between male and female connectors and the like.

What is claimed is:

1. An electronic apparatus comprising:

a connector receiving an electrode of a plug, the electrode extending forward from a main body of the plug; and a restraint member spaced from the connector, said restraint member designed to contact the main body of the plug so that a predetermined spacing is defined between a front end of the main body of the plug and an end of the connector when the connector receives the electrode.

2. The electronic apparatus according to claim 1, wherein a contact surface is defined in the restraint member so as to contact a peripheral surface of the plug.

3. The electronic apparatus according to claim 2, wherein said restraint member comprises an annular member defining said contact surface at an inner peripheral surface.

4. The electronic apparatus according to claim 1, wherein said restraint member has a first contact surface designed to contact a small cylindrical surface of the plug and a second contact surface designed to contact a large cylindrical surface of the plug, the large cylindrical surface having a diameter larger than that of the small cylindrical surface.

5. The electronic apparatus according to claim 4, wherein said restraint member comprises an annular member defining the first and second contact surfaces at an inner surface.

6. The electronic apparatus according to claim 1, wherein said restraint member has a contact surface designed to contact a step defined between a small cylindrical surface and a large cylindrical surface having a diameter larger than that of the small cylindrical surface.

7. The electronic apparatus according to claim 6, wherein said restraint member comprises an annular member having an inner surface designed to contact the small cylindrical surface.

8. The electronic apparatus according to claim 1, wherein said connector is mounted on a printed circuit board.

9. The electronic apparatus according to claim 8, wherein said restraint member is integral to the enclosure designed to contain at least the printed circuit board.

10. The electronic apparatus according to claim 8, wherein a major circuit component of the electronic apparatus is mounted on the printed circuit board.

11. An electronic apparatus comprising:

a first connector receiving an electrode of a second connector, the electrode extending forward from a main body of the second connector; and a restraint member spaced from the first connector, said restraint member designed to contact the main body of the second connector so that a predetermined spacing is defined between a front end of the main body of the second connector and an end of the first connector when the first connector receives the electrode.

12. An enclosure for an electronic apparatus, comprising:

an enclosure body defining an opening for receiving a main body of a plug coupled to a connector, the plug having an electrode extending forward from the main body of the plug; and a restraint member fixed in the opening and spaced from the connector, said restraint member designed to receive the main body of the plug so that a predetermined spacing is defined between a front end of the main body of the plug and an end of the connector when the connector receives the electrode.

13. The enclosure according to claim 12, wherein said restraint member is integral to the enclosure body.

14. The enclosure according to claim 12, wherein a contact surface is defined in the restraint member so as to contact a peripheral surface of the plug.

15. The enclosure according to claim 14, wherein said restraint member comprises an annular member defining said contact surface at an inner peripheral surface.

16. The enclosure according to claim 12, wherein said restraint member has a first contact surface designed to contact a small cylindrical surface of the plug and a second contact surface designed to contact a large cylindrical surface of the plug, the large cylindrical surface having a diameter larger than that of the small cylindrical surface.

17. The enclosure according to claim 16, said restraint member comprises an annular member defining the first and second contact surfaces at an inner surface.

18. The enclosure according to claim 12, wherein said restraint member has a contact surface designed to contact a step defined between a small cylindrical surface and a large cylindrical surface having a diameter larger than that of the small cylindrical surface.

19. The enclosure according to claim 18, wherein said restraint member comprises an annular member having an inner surface designed to contact the small cylindrical surface.

20. An enclosure for an electronic apparatus, comprising:

an enclosure body defining an opening for receiving a main body of a male connector coupled to a female connector, the male connector having an electrode extending forward from the main body of the male connector; and a restraint member fixed in the opening and spaced from the female connector, said restraint member designed to receive the main body of the male connector so that a predetermined spacing is defined between a front end of the main body of the male connector and an end of the female connector when the female connector receives the electrode.

21. The electronic apparatus according to claim 1, wherein a hollow portion is defined in the connector and a predetermined spacing is defined between a front end of the electrode of the plug and a bottom of the hollow portion when the connector receives the electrode.

* * * * *